US008356367B2

(12) United States Patent
Flynn

(10) Patent No.: US 8,356,367 B2
(45) Date of Patent: Jan. 22, 2013

(54) ADJUSTABLE SUPPORT SYSTEM FOR UNDERMOUNTED SINKS

(76) Inventor: Peter S Flynn, Camas, WA (US)

( * ) Notice: Subject to any disclaimer, the term of this patent is extended or adjusted under 35 U.S.C. 154(b) by 352 days.

(21) Appl. No.: 12/658,977

(22) Filed: Feb. 18, 2010

(65) Prior Publication Data

US 2010/0230563 A1 Sep. 16, 2010

Related U.S. Application Data

(60) Provisional application No. 61/209,785, filed on Mar. 11, 2009.

(51) Int. Cl.
*A47K 3/16* (2006.01)
*E03C 1/33* (2006.01)

(52) U.S. Cl. ..... 4/634; 4/631; 4/633; 248/500

(58) Field of Classification Search ..... None
See application file for complete search history.

(56) References Cited

U.S. PATENT DOCUMENTS 2,818,579 A * 1/1958 Katz ..... 4/633
3,008,150 A * 11/1961 Lyon, Jr. et al. ..... 4/650
3,813,707 A * 6/1974 Fowell ..... 4/650
4,432,106 A * 2/1984 Smith ..... 4/633
5,538,206 A 7/1996 Sather
5,664,265 A * 9/1997 Gotter et al. ..... 4/634
5,678,799 A 10/1997 Jorgensen et al.
5,743,501 A * 4/1998 Rapp ..... 248/201
6,076,788 A 6/2000 Akiyama
6,216,992 B1 * 4/2001 Bisonaya et al. ..... 248/212
6,793,190 B2 * 9/2004 White et al. ..... 248/500
7,040,586 B2 5/2006 Kusber
7,096,520 B2 8/2006 Nicolia
7,413,156 B1 8/2008 Cho
7,429,021 B2 * 9/2008 Sather et al. ..... 248/201
8,070,110 B2 * 12/2011 Jones et al. ..... 248/27.1

* cited by examiner

*Primary Examiner* — Amy J Sterling
(74) *Attorney, Agent, or Firm* — Peter H. Thimm

(57) ABSTRACT

An adjustable support device for under-mounted sanitary fixtures which enables the installation of rimless and rimmed fixtures to a countertop without the use of counter attaching hardware. The system includes mounting brackets for attachment to under-counter support cabinetry and moveable carriages suspended from the mounting brackets by adjustable lift actuators. Length adjustable hanger beams are attached to the opposing moveable carriages to create a support surface for the fixtures. The moveable carriages and attached hanger beams are lowered by the lift actuators to accommodate the insertion of a sanitary fixture and then raised to position the supported, upward facing rim of the fixture to the desired position relative to the countertop.

8 Claims, 11 Drawing Sheets

ADJUSTABLE SUPPORT SYSTEM FOR UNDERMOUNTED SINKS

CROSS-REFERENCE TO RELATED APPLICATIONS

This application claims priority from a U.S. Provisional Application No. 61/209,785 filed on 11 Mar. 2009 by Peter S. Flynn. The entire contents of that application are incorporated by reference herein.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION

1. Field of Invention

The present invention relates generally to the field of devices for the installation of sanitary fixtures and appliances, and more specifically, devices used for the under-counter installation of sanitary fixtures.

2. Background

Ceramic or metal cast or machined rimless sinks, sometimes called Farmhouse or Apron sinks, are very heavy fixtures which require robust support systems on which to mount them or suspend them so that they do not detach from the countertop to which they are mounted. Their substantial weight is due to the material from which they are manufactured and the significant volume of water the larger models of some of these sinks can accommodate. In addition to being very heavy, these sinks are often hand crafted and hence are not completely symmetrical in shape or even in height. Furthermore, it has become increasingly fashionable to mount these sinks underneath stone or masonry countertops in which it is difficult or impossible to attach mounting hardware without drilling receiving holes into the underside of the stone surface to accommodate the hardware. Even if mounting hardware can be effectively installed into the underside of the masonry or non masonry counters, the sinks have no rims or lips on the upper edge with which to engage this mounting hardware.

Information relevant to attempts to address these problems can be found in U.S. Pat. Nos. 7,096,520, 7,429,021, 5,743,501, 5,538,206 and Published Application No. 20050211852. However, each one of these references suffers from one or more of the following shortcomings: the disclosed devices are mounted on the floor or bottom of the cabinet beneath the sink thereby occupying much of the useful floor space beneath the sink; the devices although adjustable or sizeable prior to installation, are not easily adjustable once the sink or fixture is in place; the devices require shimming after the fixture is installed to ensure proper mating of the fixture to the underside of the counter; the device requires that the sink or fixture have a rim that can be engaged by a clip or similar fixing device.

As a result of the shortcomings of the aforementioned attempted solutions to this problem, a commonly encountered installation technique for these types of sinks relies primarily on the construction of wooden frames or boxes which rest on the floor beneath the sink or attach to the opposing vertical surfaces of the countertop support cabinetry and support the sink from beneath while relying on shims and caulk to ensure the sink is level and fully mated to the underside of the countertop. Again, these wooden support systems and the associated shims take up a significant amount of space beneath the sink, are not adjustable to accommodate non levelness in the sink or post installation shifting, and are prone to rot from exposure to water seepage.

What is needed is a robust, water resistant, adjustable sink support apparatus which allows a heavy ceramic, cast, molded, extruded or machined, rimless or rimmed sink to be mounted and adjusted for levelness under a masonry or non masonry countertop so that the upward facing edge of the sink engages with the underside of the countertop. This sink support apparatus needs to function without installing or adhering mounting hardware to the underside of the countertop and without consuming all the space beneath the sink with wooden framing that relies on the use of shims or other non precise gap filling measures to ensure the sink is properly engaged with the underside of the countertop.

SUMMARY

The present disclosure advantageously addresses one or more of the aforementioned deficiencies in the field of sanitary fixture support devices by providing a high strength, light weight, water resistant adjustable sink support apparatus that attaches to the opposing, surfaces of the under-counter support cabinetry and suspends rimless and rimmed sinks, as well as other sanitary fixtures, on vertically and horizontally adjustable supports beneath the countertop without the need for bulky framing, support boxes, or shim stock support from beneath the sink, nor the need for adhesive or attachment hardware to engage the top edge of the sanitary fixture to the underside of the counter.

The device includes mounting brackets for attachment to the vertical surfaces of the under-counter support cabinetry and moveable carriages suspended from the mounting brackets by adjustable lift actuators. Length adjustable hanger beams are attached to the opposing, moveable carriages to create a support surface for the sanitary fixture. The moveable carriages and attached hanger beams are lowered by adjustable lift actuators to accommodate the insertion of a sink or other sanitary fixture and then raised to position the upward facing rim of the fixture to the desired height with respect to the countertop it is being installed under; either pressed against the underside of the countertop or in a position flush with or protruding above the top surface of the counter.

One embodiment of the present disclosure may include an adjustable lift actuator comprising an externally threaded, rotatable bolt with a head at one end to act as a keeper and a slot at the other for receiving a screw driver. The bolt is suspended by the bolt head through a hole in the horizontal suspension support surface of the mounting bracket where the diameter of the hole is larger than that of the threaded shaft of the bolt but smaller than that of the head of the bolt. The bolt further passes through a hole in the horizontally oriented hanger support platform of the moveable carriage situated below and aligned in parallel with the suspension support surface of the mounting bracket. A threaded nut permanently mounted beneath the hole in the hanger support platform threadably engages the shaft of the bolt passing through the hole and the nut. The hanger support platform of the moveable carriage is also attached to one end of a hanger beam which runs horizontally from one moveable carriage to a similar unit situated on the under counter support cabinetry on the opposite side of the fixture installation opening. When the threaded shaft of the bolt is turned by inserting and rotating a screw driver in the slot in the exposed end of the bolt, the moveable carriage and attached hanger beam travels up or down the thread to the desired height.

In another embodiment the adjustable lift actuator may take the form of a threaded lead screw with a rotatable, mating nut. In this embodiment the screw is permanently fixed to the suspension support surface of the mounting bracket so that is cannot rotate and may pass through an unthreaded hole in the horizontally-oriented hanger support platform of the moveable carriage which is situated below and aligned in parallel with the suspension support surface of the mounting bracket. The internally threaded, rotatable nut mates with the threaded lead screw and supports the underside of the hanger support platform of the moveable carriage. When the nut is turned on the fixed lead screw the moveable carriage is moved along the axis of the lead screw to the desired height.

In another embodiment the lift actuator may be a ratcheting device that allows the height of the moveable carriage to be ratcheted up or down to a desired height while loaded or unloaded.

In still another embodiment the lift actuator may be a chain suspended from a hook on the underside of the suspension support surface of the mounting bracket and attached to a hook on the topside of the hanger support platform of the moveable carriage. The height of the hanger support platform may be adjusted by selecting a different link of the chain to attach to the support plate of the moveable carriage.

In another embodiment, the hanger beam which contacts the underside of the supported fixture is adjustable in length so that it can be sized and locked to the desired length so as to accommodate a wide variety of fixture sizes.

A novel and non obvious feature of the device and associated method is the attachment of the apparatus to vertical surfaces of the under counter support cabinetry instead of the underside of the counter or the floor beneath the fixture.

Another novel and non obvious feature of the device is the in-situ, height adjustable moveable carriages which allow the apparatus to be easily lowered and raised with or without the fixture in place.

The device affords the user one or more of the following advantages. The device does not take up floor space beneath the fixture. Because the mounting brackets attach to vertical surfaces of under-counter support cabinetry, there is no need for the device to be supported by vertical bracing on the floor beneath the fixture. This leaves the area beneath the fixture free for storage.

The device requires no attachment to the counter itself. Because the mounting brackets attach to the vertical surfaces of the under-counter support cabinetry and the lift actuators move the sanitary fixture into contact with the underside of the counter, there is no need to drill holes in the underside of the counter for receiving hardware. This is especially significant where the counter is made of masonry or other hard material. Additionally, there is no need to use adhesive to hold the fixture to the underside of the counter.

Because no hardware is used to attach the sanitary fixture to the underside of counters, the device can be used to install rimless and rimmed sinks to the underside of the counter.

The device is easily adjustable both before and after the fixture is emplaced allowing for ease of installation and removal and precise positioning during installation, even for fixtures which may be asymmetric. Furthermore, because the device is highly adjustable when the fixture is in place, there is no need for the use of shims to optimize the positioning of the fixture. Furthermore, should any shifting or settling occur after installation, the positioning of the sanitary fixture can easily be adjusted due to the easy access to the lift actuators when the fixture is present. The adjustability of the hardware also means that initial positioning and attachment of the mounting brackets to the support cabinetry does not need to be precisely accomplished. If one bracket should be at a slightly different height than the others, this error in installation can be accommodated by adjusting the lift actuator for that bracket to a height which corrects for the error in bracket placement.

Finally, because the device does not contain any wooden components, there is no danger of damage from exposure to water.

It is therefore the purpose of this device to serve as an adjustable support apparatus for sanitary fixtures which enables the installation of rimless and rimmed sanitary fixtures in under-mounted, flush-mounted or protruding positions relative to a counter without requiring attachment to the counter itself or support from the floor beneath the sanitary fixture.

The present invention will now be described more fully with reference to the accompanying drawings, which are intended to be read in conjunction with both this summary, the detailed description, and any preferred or particular embodiments specifically discussed or otherwise disclosed. This invention may, however, be embodied in many different forms and should not be construed as limited to the embodiments set forth herein; rather, these embodiments are provided by way of illustration only so that this disclosure will be thorough, and fully convey the full scope of the invention to those skilled in the art.

DESCRIPTION

Figure 1:
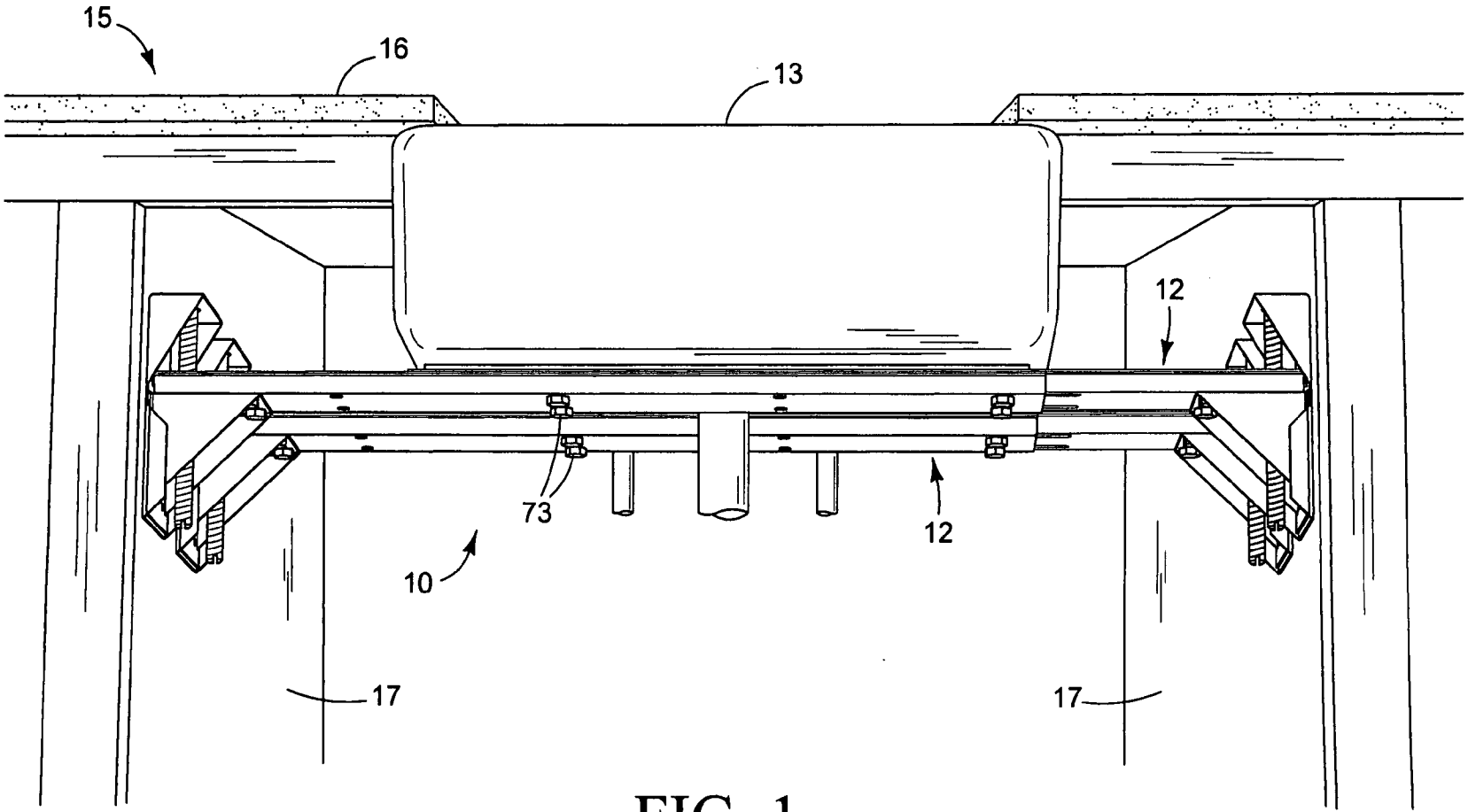
FIG. 1 is a perspective view illustrating the sink support system and supported fixture as well as surrounding cabinetry and counter.
Figure 2:
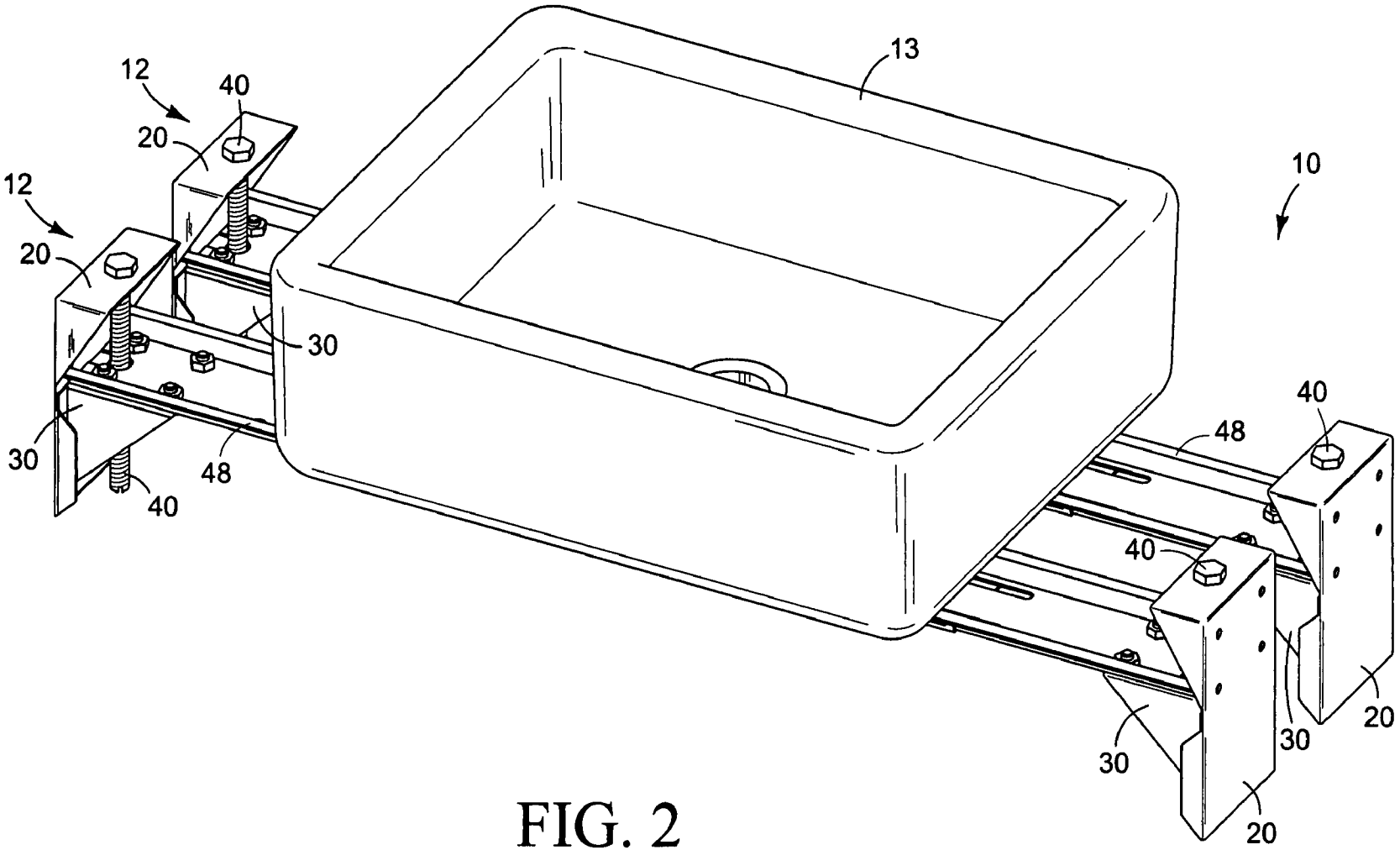
FIG. 2 shows in perspective the sink support system.

The present disclosure is directed to an adjustable support apparatus for under-mounted sinks. The device as shown in FIGS. 1 and 2 consists of a plurality of mounting brackets 20 which are attached, in pairs, to opposing vertical surfaces of the surrounding under-counter support cabinetry 17. A plurality of moveable carriages 30 equal in number to the amount of installed mounting brackets 20 are suspended from said mounting brackets 20 by means of a lift actuator 40. Said carriages 30 slideably engage along a vertical plane with said mounting brackets 20 in a manner that ensures said moveable carriages 30 do not laterally displace beyond the surface covered by said mounting bracket 20. A length adjustable hanger beam 48, which is sized to accommodate horizontal distances between said opposing pairs of carriages 30 and is fixed in size by a locking mechanism 73, attaches to said opposing carriages 30 thereby spanning the gap between the supports and completing the adjustable support system 10 for the sink 13 to rest on.

Mounting Bracket

Figure 5:
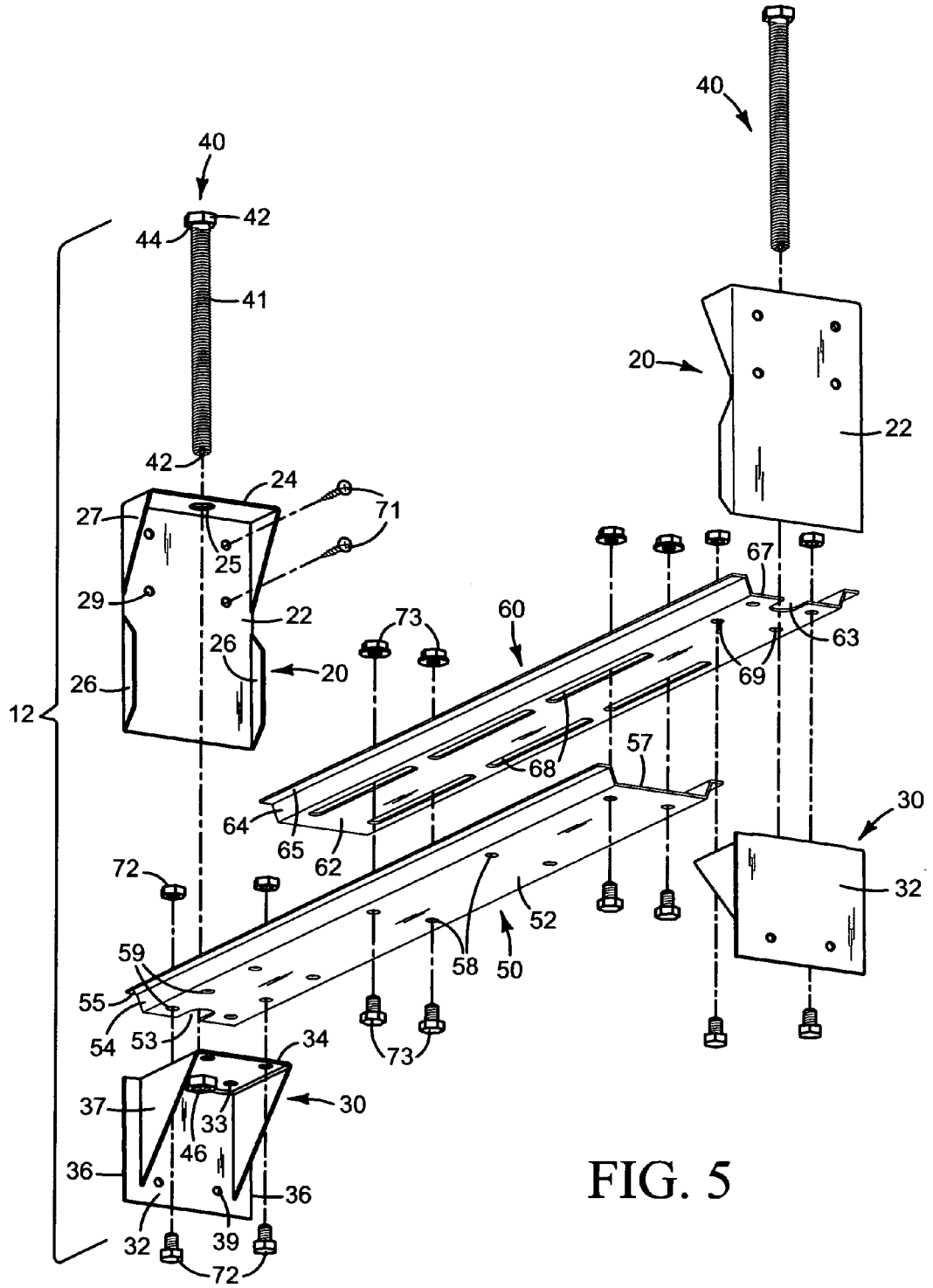
FIG. 5 is an exploded view of the invention of FIG. 1.

The mounting bracket 20 as shown in FIG. 5 comprises a mounting plate 22, a suspension support surface 24, guide flanges 26 and support braces 27. The mounting plate 22 attaches to the opposing vertical surfaces of the counter-support cabinetry 17 by use of fasteners such as screws, nails or adhesive. The suspension support surface 24 extends perpendicularly from plane of the mounting plate 22 towards the opposing vertical surface of the supporting cabinets 17 and is joined to the mounting plate 22 at right angles. Support braces 27 reinforce the union between the mounting plate 22 and the suspension support surface 24 and maintain them at the desired angle of intersection with each other, preferably perpendicular. The suspension support surface 24 comprises an upward facing surface and a hole or slot 25 through which the adjustable lift actuator 40 passes. The guide flanges 26 extend orthogonally from the vertical edges of the mounting plate 22 for the purposes of preventing the lateral displacement of the slideably engaged carriage 30.

The purpose of the mounting bracket 20 is to provide an immovable anchor for the carriage 30 to hang from. It is sized to allow a plurality of fastening hardware to be inserted through holes 29 far enough apart on the vertical mounting plate 22 to prevent localized deformation of the supporting cabinetry 17 and to allow easy access to the adjustable lift actuator 40 with common hand-tools. The thickness of the mounting bracket 20 depends on the material chosen to fashion it from but must be strong enough to support the anticipated load which itself is dependent on the size, volume and manufacturing material chosen for the sink.

Moveable Carriage and Adjustable Lift Actuator

Figure 8:
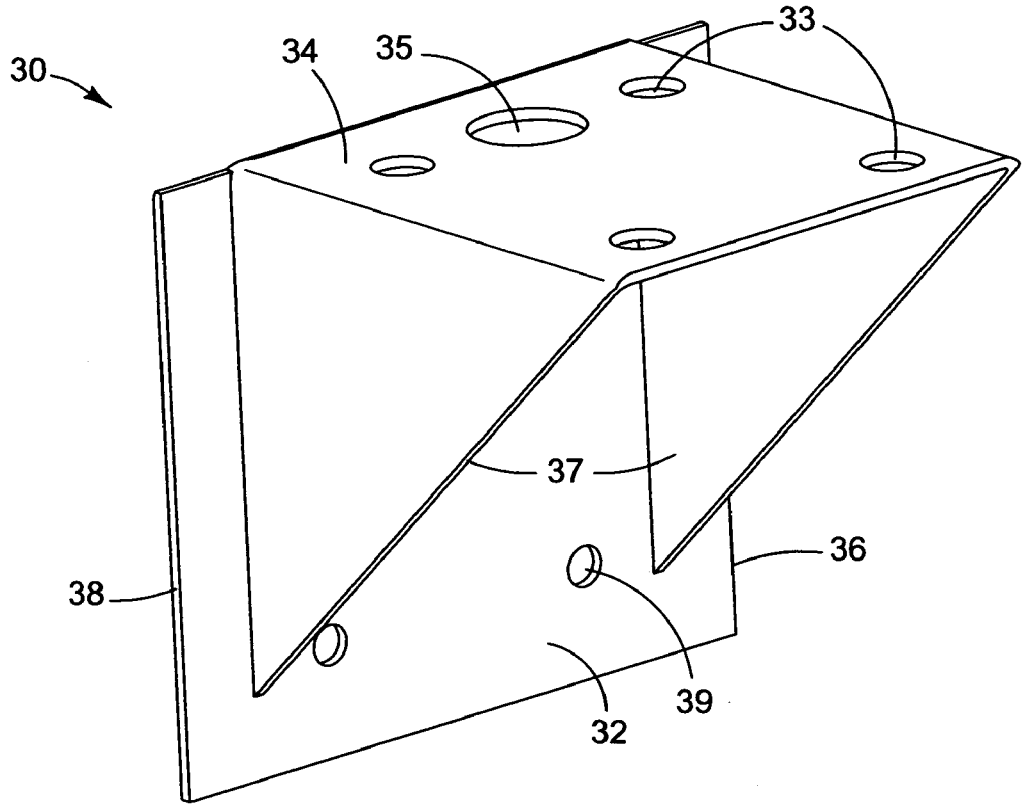
FIG. 8 is an isometric view of the moveable carriage
Figure 10:
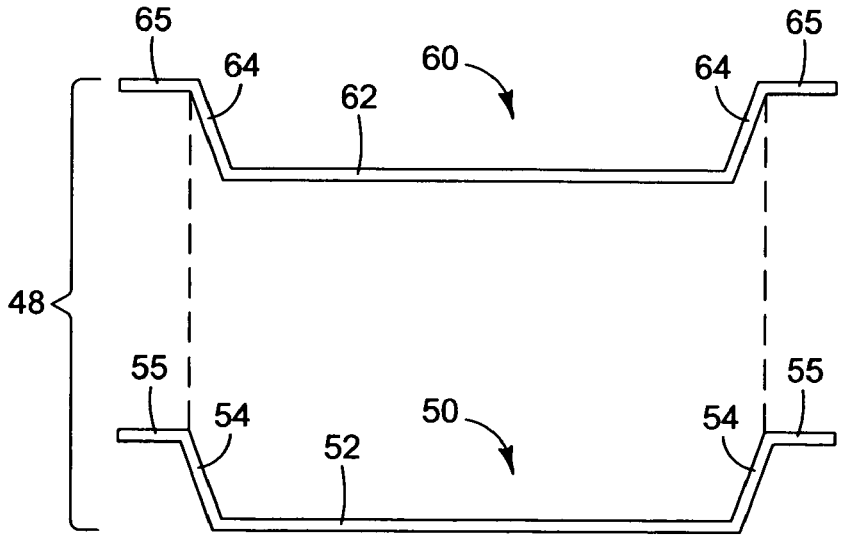
FIG. 10 is an exploded end view demonstrating nestability of support members.
Figure 9:
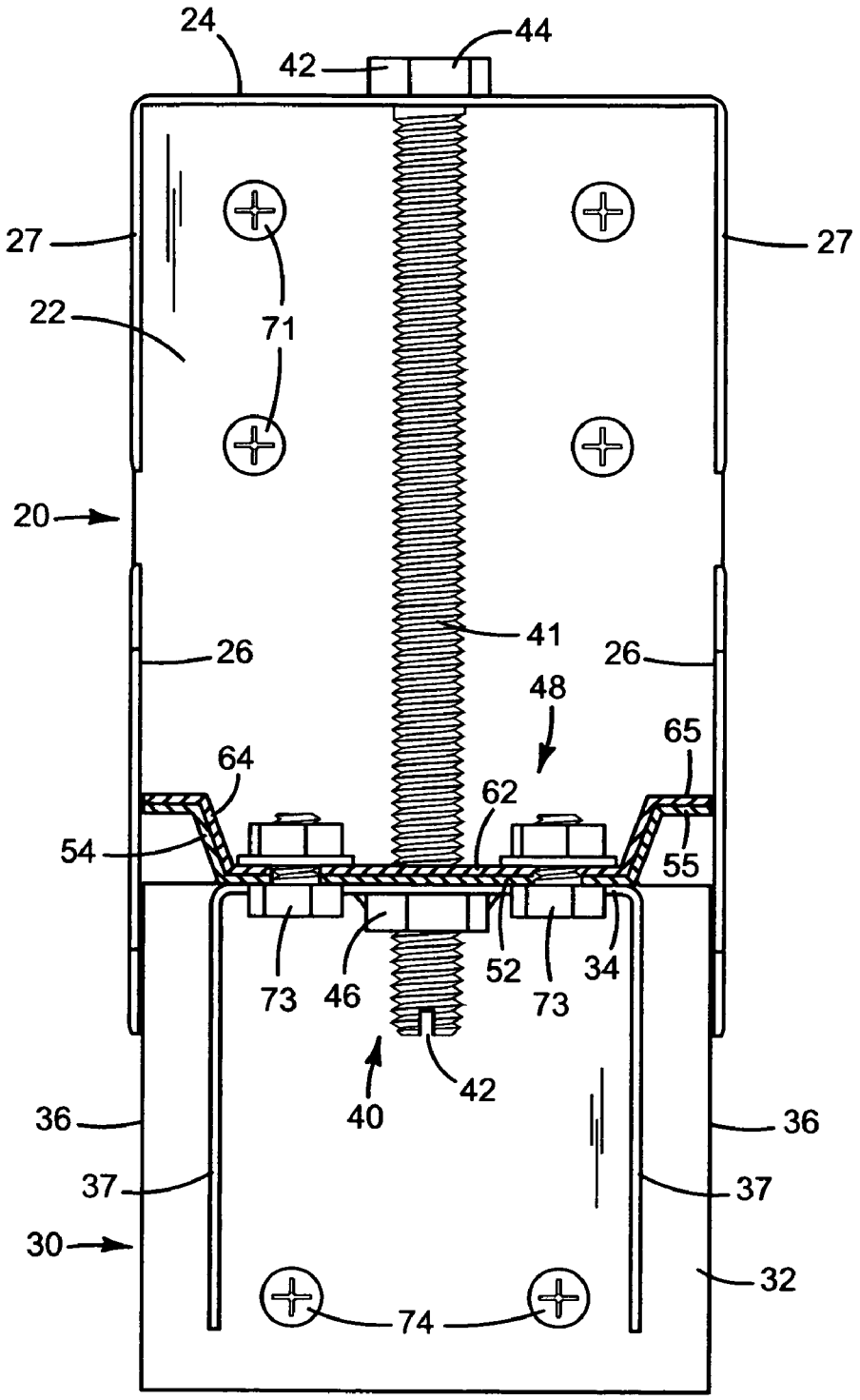
FIG. 9 is an end view section of the adjustable lift apparatus of FIG. 7.
Figure 11:
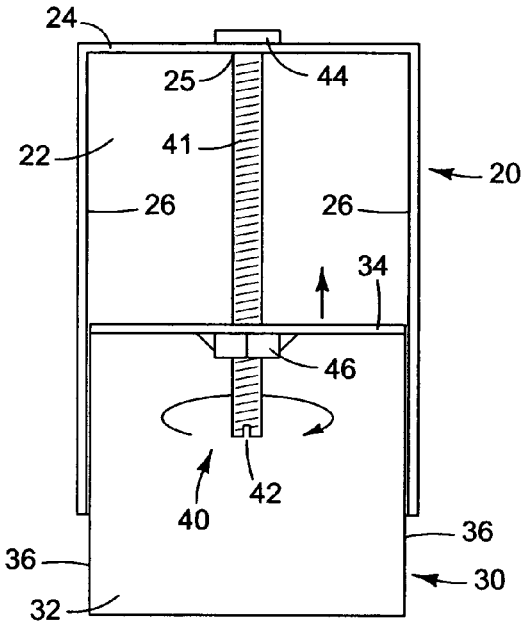
FIG. 11 shows another embodiment of the adjustable lift actuator.
Figure 12:
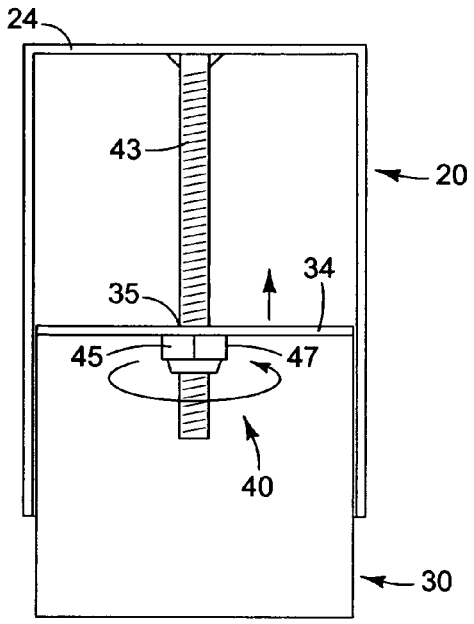
FIG. 12 shows another embodiment of the adjustable lift actuator.
Figure 13:
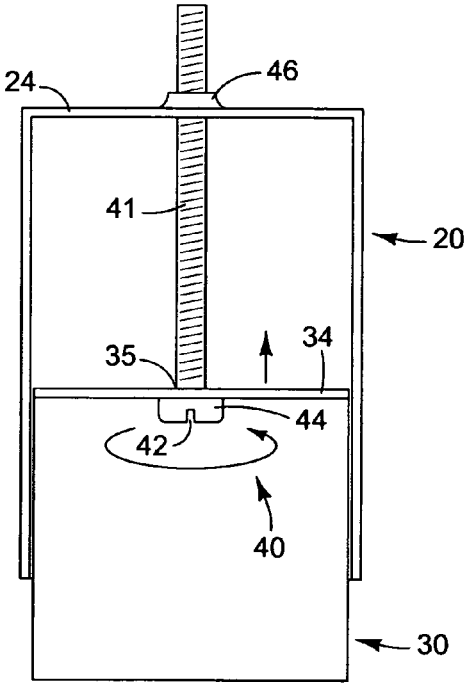
FIG. 13 shows yet another embodiment of the adjustable lift actuator.
Figure 14:
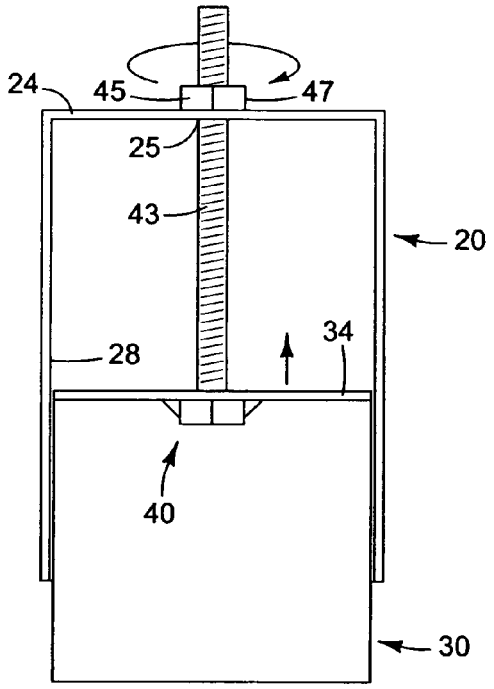
FIG. 14 shows yet another embodiment of the adjustable lift actuator.

The moveable carriage 30 as Shown in FIGS. 5 and 8 comprises a sliding plate 36, a hanger support platform 34, which extends orthogonally from the plane of the sliding plate 36, and a plurality of support braces 37 which reinforce the union of the two plates and maintain them at the desired angle of intersection, preferably perpendicular. The sliding plate 36 slideably engages with the exposed surface of the vertical mounting plate 22 of the mounting bracket 20 and fits between the guide flanges 26 of the vertical mounting plate 22 so that the sliding plate 36 does not displace horizontally when it slides up and down. The hanger support platform 34 comprises a horizontal surface with openings 35 for accommodating the adjustable lift actuator 40 such as holes, slots or hooks and structures for attaching the hanger beams 48 such as holes 33 for accommodating fasteners 72 or slots for accommodating straps. The attachment of the hanger beams 48 also prevents the moveable carriages 30 and associated lift actuator 40 from moving out of the vertical plane defined by the mounting plate 22 of the mounting bracket 20.

The adjustable lift actuator 40 comprises a vertical shaft 41 such as an externally threaded lead-screw, a chain or saw-toothed shaft, a load-bearing element 44 such as a shank head, cotter pin or keeper device, an adjusting device 46, 47, and a rotational drive feature 42 such as a slot for a screwdriver or a hex head or wing nut. The load bearing element 44 suspends the adjustable lift actuator 40 from the suspension support surface 24 of the mounting bracket 20 thereby preventing the actuator 40 from falling through the hole 25 in the suspension support surface 24. The adjusting device 46, 47 may take the form a nut positioned above or below a hole 35 in the hanger support platform 34, or a hook for looping a chain link or a ratcheting mechanism and is used to adjust the distance between the suspension support surface 24 and the hanger support platform 34 by the interaction of the vertical shaft 41 with the adjusting device. The adjustable lift actuator 40 may also include a stop at the bottom of the vertical shaft 41 in the form of a cotter pin or nut to prevent the moveable carriage 30 from sliding past the bottom end of the vertical shaft 41 of the lift actuator 40.

The function of the hanger support platform 34 and the lift actuator 40 is to raise or lower each corner of the supported sink independently thereby ensuring that the upward facing edge of the supported sink 13 is at the precise and desired height. The width of the sliding plate 36 and horizontal hanger support platform 34 are sized so that they are slightly narrower than the width defined by the guide flanges 26 of the mounting brackets 20 thereby enabling the sliding plate 36 to move vertically between the guide flanges 26 with minimal lateral displacement. The height of the sliding plate 36 must be proportional to the length of the vertical shaft 41 of the lift actuator 40 so that the sliding plate 36 remains slideably engaged with the mounting plate 22 when the lift actuator 40 is lowered to its minimum position defined by the length of the vertical shaft 41. The thickness of the material chosen to fashion the carriage 30 and lift actuator 40 must be great enough to support the anticipated load which itself is dependent on the size, volume and manufacturing material chosen for the sink.

Hanger Beam

Figure 6:
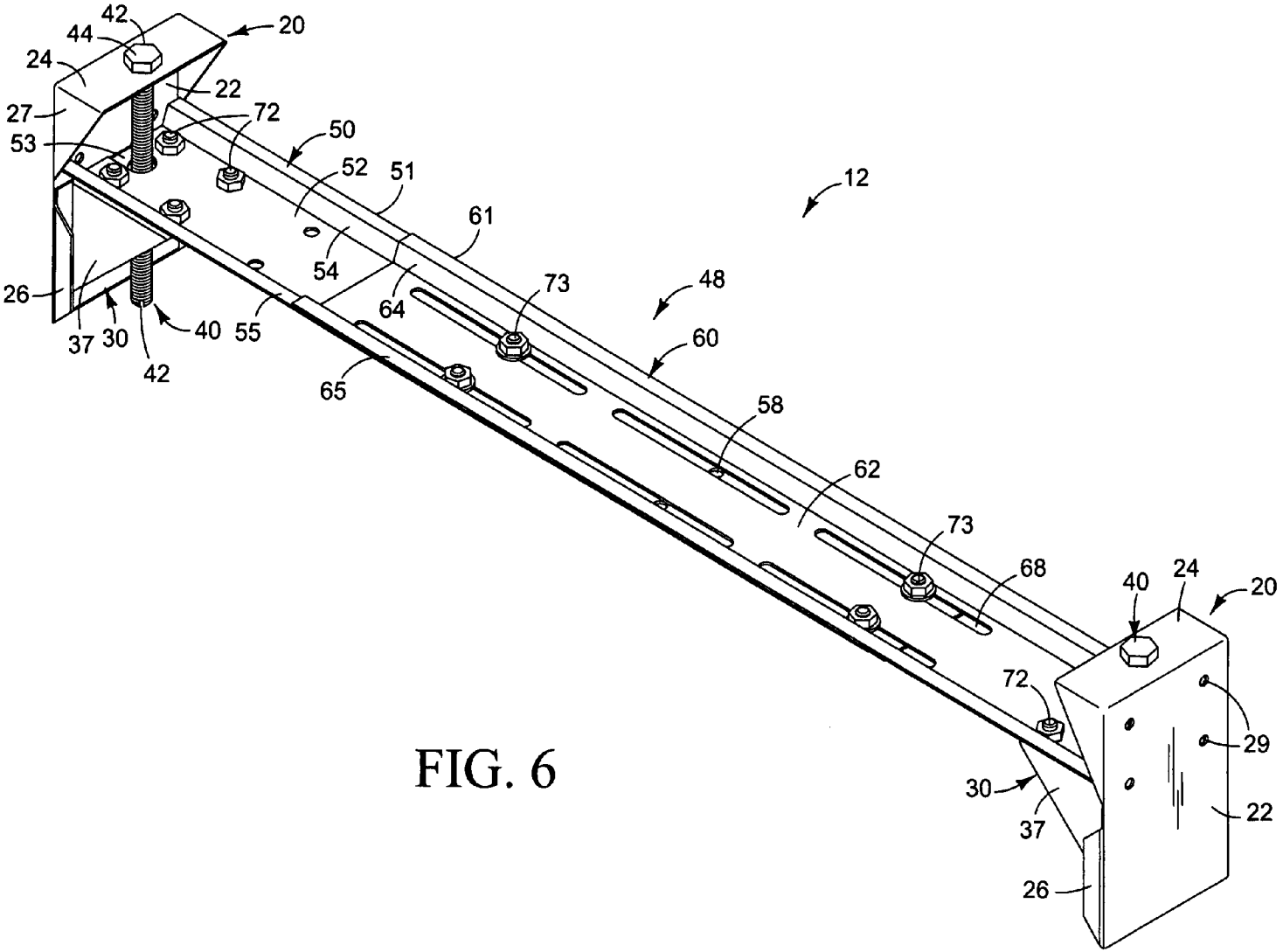
FIG. 6 is an isometric view of one embodiment of the invention.
Figure 15:
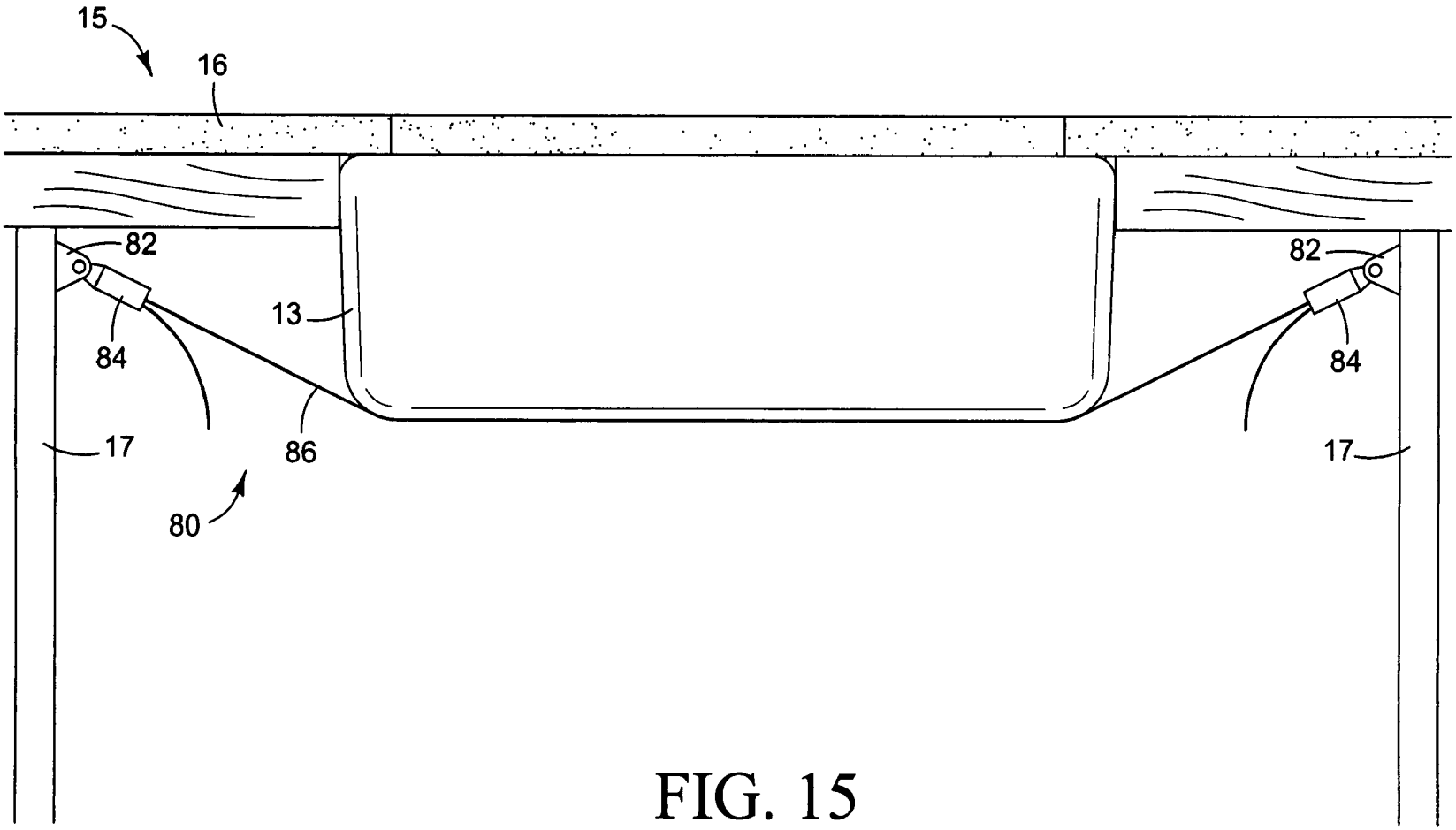
FIG. 15 shows another embodiment of an appliance lift and support mechanism.

The hanger beam 48 as show in FIGS. 6 and 15 comprises a length-adjustable device such as telescoping tubes, nesting slideably connected plates 50, 60 capable of being attached to the hanger support platform 34 and spanning the distance between the opposing hanger support platforms 34 thereby providing a platform for the underside of the supported sink 13. The beam 48 further comprises a mechanism for locking 73 the beam at a selected length and a device for increasing the friction between the beam 48 and the sink such as a rubber or foam strip 18, so that the sink does not slide across the beams 48 after being positioned on the beams 48.

The function of the hanger beam 48 is to provide a sturdy surface on which the underside of the sink 13 rests for support. The surface of the beam 48 presses against the underside of the sink thereby forcing the top edge of the sink into contact or close proximity with the underside of the counter 16 to which it is mounted. The force at which the beam 48 engages the underside of the sink 13 can be adjusted by shortening the effective length of the adjustable lift actuator 40 so that the hanger support platform 34 and supported hanger beam 48 move upward thereby engaging the underside of the supported sink 13 with increased pressure. The thickness of the material used to form a beam 48 is dependent on the type of material chosen and the presence of any reinforcing devices in the beam 48, as well as the number of beams installed for support, but must be sufficient to support significant loads the magnitude of which depend on the size of the sink, weight of the material used to fashion it and the volume of water and other contents the sink can hold. The length of the beam sections 50, 60 depends on the width that must be spanned which itself is determined by the distance between the opposing vertical mounting surfaces for the support system. The width can be chosen so that the beam 48 fits inside the guide flanges of the mounting bracket or it can be wider than the mounting bracket in order to provide a larger support surface.

The mounting brackets 20, carriages 30 and lift actuators 40 can be made from a variety of materials but preferably machined, rolled or stamped metal or molded, extruded or machined high strength polymer or plastic. The hanger beams 48 are made from the same material.

Figure 3:
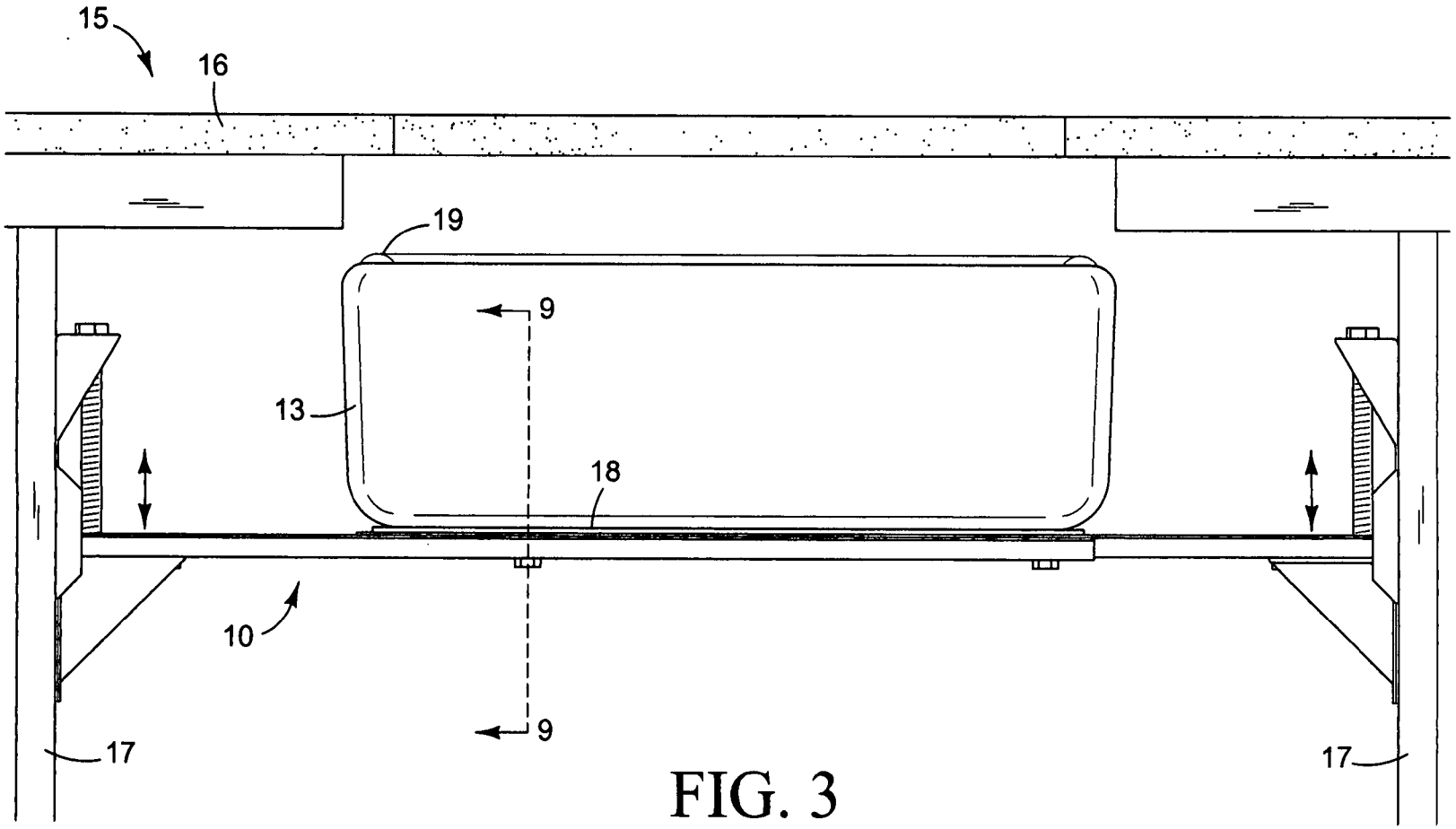
FIG. 3 is a front elevation showing the invention supporting a fixture prior to emplacement.

The invention is used by installing the sink support apparatus 10 beneath the counter 16 at the location where the sink 13 is to be positioned as shown in FIG. 3. This is accomplished by fastening the mounting brackets 20 to the opposing, surfaces of the counter-support cabinets 17 located beneath the counter 16 on opposing sides of the sink's 13 intended location, said opposing, surfaces 17 being located either to the left and right or front and back of the sink 13. From these mounting brackets 20 moveable carriages 30 are suspended from lift actuators 40 which raise and lower the carriages 30 within the confines of guide flanges 26 which extend perpendicularly from the vertically oriented edges of the mounting brackets 20, said flanges 26 extending sufficiently to prevent the moveable carriages 30 from displacing laterally from the plains defined by the guide flanges 26. Horizontal hanger beams 48 which are adjustable for length are then fastened to the hanger support platforms 34 of the moveable carriages 30 and are sized so that they span the distance between opposing hanger support platforms 34. The sizing of the hanger beams 48 is fixed through a locking mechanism 73 and then the hanger beam 48 is attached to the opposing, moveable carriages 30 suspended by adjustable lift actuators 40 from suspension support surfaces 24 of mounting brackets 20 mounted in positions on the opposing, vertical, counter-support surfaces 17. Additional hanger beams 48 are installed on other opposing pairs of carriages 30 which are themselves suspended from additional pairs of opposing mounting brackets 20.

Figure 4:
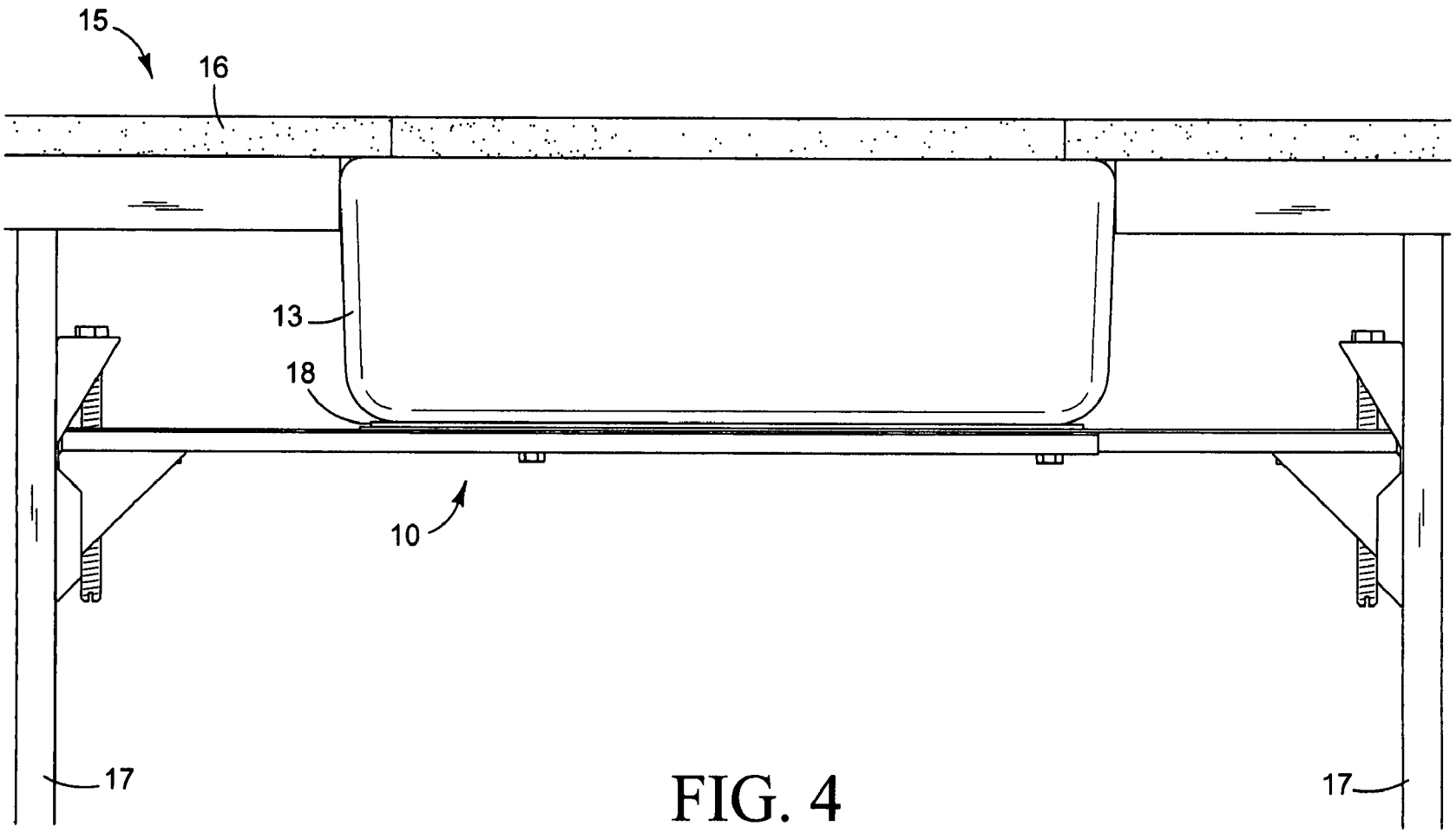
FIG. 4 is a front elevation showing a fixture as supported in place.

Once a sufficient number of hanger beams 48 have been installed, normally 2-3, the hanger beams 48 are lowered to the maximum extent allowed by the adjustable lift actuator 40. As shown in FIG. 3, the sink 13 is then slid in place from a position in front of the support cabinets until the underside of the sink 13 rests securely on the suspended hanger beams 48 and the upward opening of the sink 13 is in the correct position with respect to the actual or planned location of the opening in the countertop 16 that is cut to align with the sink 13. As shown in FIG. 4, the lift actuators 40 are then adjusted in a manner to move the hanger support platforms 34 and beams 48 and supported sink 13 upwards until the upward facing edge of the sink 13 is at the desired height relative to the countertop 16, either pressed against the underside, or in a position that is flush with or protruding above the top surface. Individual lift actuators 40 are further adjusted to accommodate any non-levelness in the sink 13 observed upon installation. A bead of sealant 19 is then placed around the inner edge of the mating surface between the inside, upward facing edge of the sink 13 and the underside of the countertop 16 to prevent water seepage. The lift actuators 40 can then be adjusted after prolonged use to accommodate for any gaps that appear between the underside of the counter 16 and upward facing sink edge due to settling in the construction. They may also be easily adjusted downward to allow the sink 13 to be removed should it become cracked or should the owner wish to replace it with a different model.

Figure 7:
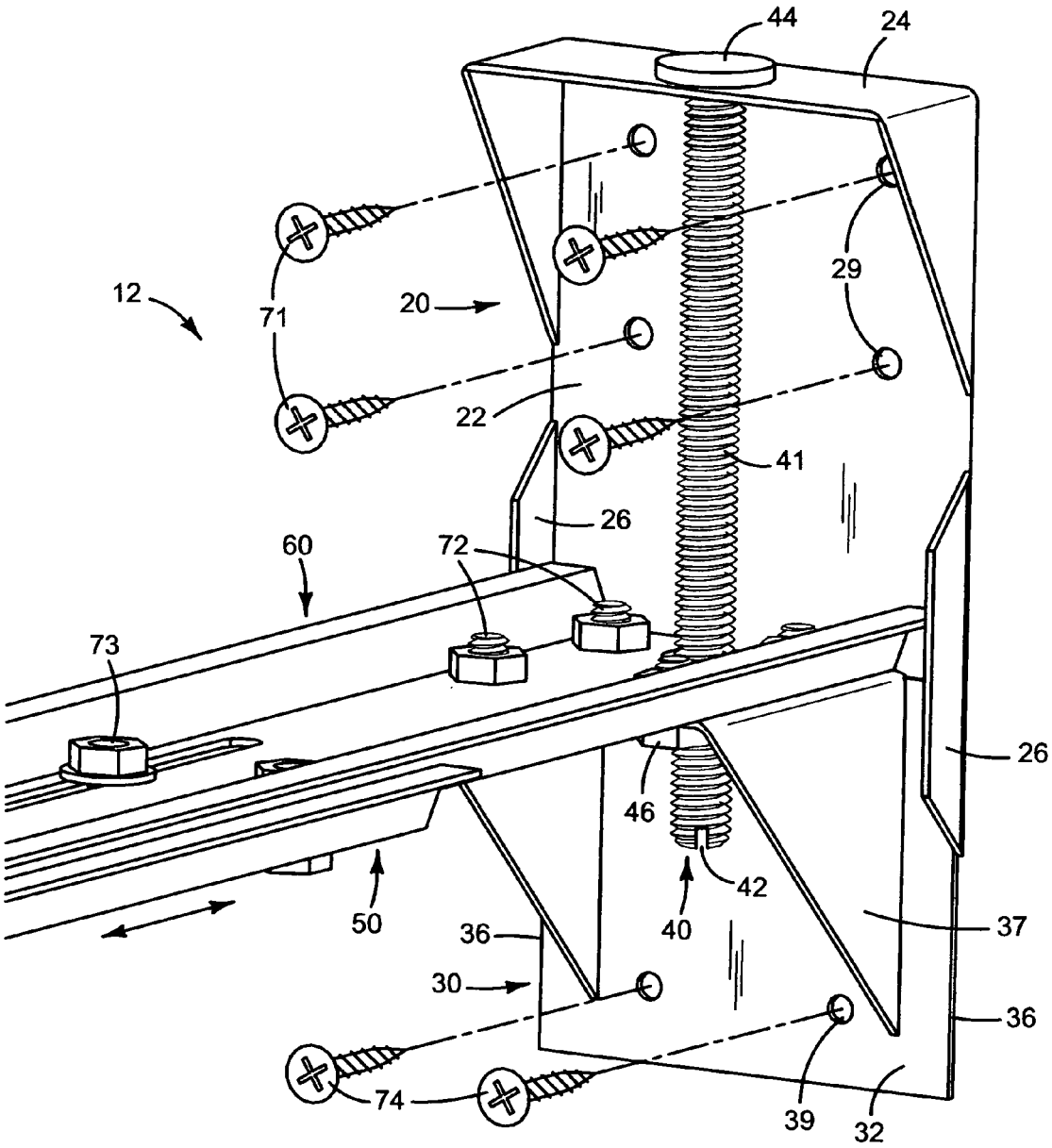
FIG. 7 is a detail of one end of the support system illustrating the mounting bracket, moveable carriage, adjustable lift actuator and a portion of the hanger beam.

One particular embodiment of the device may comprise four each mounting brackets 20, carriages 30, lift actuators 40 and four hanger beam sections 50, 60. As shown in FIG. 6-8, the mounting bracket 20 is shaped in the form of an inverted L consisting of a vertical mounting plate 22 and a horizontal suspension support surface 24 which extends orthogonally from the top edge of said mounting plate 22. The suspension support surface 24 and the vertical mounting plate 22 are reinforced by a plurality of support braces 27 which are positioned to maintain the orthogonal positioning of the suspension support surface 24 to said vertical mounting plate 22. Two guide flanges 26 extend orthogonally from the vertical edges of said vertical mounting plate 22 for the purposes of preventing the lateral displacement of the slideably engaged carriages 30. A hole 25 is positioned in the center of the horizontal suspension surface 24 for purposes of passing through and retaining a threaded vertical shaft 41. A plurality of holes are positioned in the vertical mounting plate 22 for purposes of permitting fastening hardware 71 to attach through the vertical mounting plate 22 to the support cabinetry 17.

The carriage 30 is shaped in the form of an inverted L and comprises a vertical sliding plate 36, a hanger support platform 34 which extends orthogonally from the top edge of the vertical sliding plate 36, and a plurality of support braces 37 which reinforce the union of the plate and platform and maintain them perpendicular to each other. The sliding plate 36 slideably engages with the face of the mounting plate 22 of the mounting bracket 20 and fits between the guide flanges 26 of the mounting plate 22 so that it does not displace horizontally when it slides up and down. The hanger support platform 34 comprises a flat surface with a plurality of small holes for attaching the hanger beam 48 and a larger hole 35 in the surface, said hole being positioned in the support platform so that it aligns with the hole in the suspension plate 24 of the mounting bracket 20 when the hanger support platform 34 is positioned inside the guide flanges 26 of the mounting bracket 20. The purpose of the hole 35 being to accommodate the passage of an externally threaded shaft 41 to be used as the lift actuator.

The externally threaded shaft 41 comprises a shaft which is threaded along its entire length with a load bearing head 44 at one end and a slotted end 42 designed to accept a screwdriver at the other. An internally threaded nut 46 is attached to the underside of the horizontal support platform 34 of the carriage 30 in such a manner as to align the threads of the nut 46 with the hole in the support platform 35. The nut 46 is then fixed in place by use of a fixing medium such as adhesive, solder or weldment. The slotted end 42 of the shaft is then passed through the hole 25 in the suspension support surface 24 of the mounting bracket 22 until the keeper 44 that is permanently affixed to the shaft comes to rest on the top surface of the suspension support plate 24 thereby preventing the shaft 41 from falling through the hole 25. The moveable carriage 30 is then positioned immediately below the slotted end 42 of the threaded shaft 41 and the shaft 41 is rotated so that the external threads of the shaft 42 mate with the internal threads of the nut 46 mounted on the underside of the hanger support platform 34 thereby causing the platform 34 to rise in relation to the surrounding hardware. By turning the threaded shaft from below or above in either direction, the moveable carriage 30 can hang at an adjustable distance from the suspension plate 24. As the vertical position of the hanger support platform 34 is adjusted by turning the threaded shaft 41 inside the permanently mounted threaded nut 46, the guide flanges 26 of the mounting bracket 20 maintain the horizontal alignment of the two components.

The hanger beams 48 as shown in FIGS. 6, and 7 comprise a plurality of sections including a bottom section 50 and a top section 60 which nests inside the bottom section 50 and is slideably engaged with the bottom section 50. The bottom section 50 is comprised of a rectangular sheet of material with a first end and a second end, one or more reinforcing channels and a plurality of flanges 55 that run the length of the rectangular sheet. The reinforcing channels comprise a web 52 surrounded on both sides by a vertical or angled side 54 which extend upward to the flange 55 of the bottom section 50. The sides of the reinforcing channel 54 are of a depth necessary to provide adequate strength to the rectangular sheet so that it will not deform under the anticipated load and may be oriented at angles between 45 and 90 degrees from the web to facilitate nesting of the bottom and top sections. The web 52 of the reinforcing channel contains holes 58 to accommodate fastening hardware 73 needed for fixing the size of the hanger beam 48 with the top section 60 nested inside the bottom 50 section. At least one end of the bottom section 50 contains a u-shaped notch 53 removed from the material to allow the end of the section to partially surround the threaded shaft 41 when the end of the section is position and attached to the horizontal support plate of the hanger supports. The second end of the bottom section 50 may also have the notch removed so that the section can be oriented in either direction. As shown in FIGS. 6 and 8, the ends of the bottom section 50 further comprise fastening holes to allow the end to be fastened to corresponding holes 33 in the hanger support platform 34 of the carriage 30 by the use of fastening hardware 72.

As shown in FIGS. 6 and 7, the top section 60 of the hanger beam 48 comprises a rectangular sheet of material with a first end and second end, a reinforcing channel and a plurality of flanges 65 that run the length of the section. The reinforcing channel comprises a web 62 surrounded on both side by vertical or angled sides 64 which extends upward to the flange 65. The sides of the reinforcing channel 64 are of a depth necessary to provide adequate strength to the section so that it will not deform under the anticipated load and may be oriented at angles between 45 and 90 degrees from the web to facilitate nesting of the bottom 50 and top 60 sections. In the case where the sides 64 of the reinforcing channel of the top section are vertical, the channel is of a width and depth slightly less than the width and depth of the reinforcing channel of the bottom section 50 so that the two sections can nest together and slideably engage thereby forming a sturdy horizontally adjustable hanger beam 48. The web of the reinforcing channel 62 contains slots 68 which are aligned with the holes 58 located in the web 52 of the bottom section 50, said slots 68 accommodating fasteners 73 which pass through the slots of the bottom section 50 and fix the position of the two sections relative to each other at a prescribed length. At least one end of the top section 60 contains a u-shaped notch removed from the material to allow the end of the section to partially surround the threaded shaft 41 when the end of the section is position and attached to the horizontal support platform of the carriage. A cushioning material 18 is attached to the upward facing surfaces of the flange 55, 65 of the hanger beams 48 and serve to provide a soft, high friction surface with which to engage the supported sink 13. In cases where the sink 13 rests partially on the top section 60 and partially on the bottom section 50 of the hanger beams 48, additional cushion material or other solid gap filling devices may be applied to the flange of the bottom section 50 so that the sink rests level on the hanger beam 48.

The mounting bracket 20, support brace 27 and hanger beam 48 sections are comprised of stamped stainless steel sheet metal and are formed to their final shape through machine breaking of the components. Where the support braces 27 and suspension support surface 24 of the mounting bracket 20 meet, the unions are welded together for increased strength. The support braces 37 of the carriage 30 are also welded to the face of the sliding plate 36 of the carriage 30 as is the edge of the hanger support platform 34 that intersects with the top of the sliding plate 36 of the carriage 30. The externally threaded shaft 41 is formed from a steel shaft which has been threaded and notched by tool and die processes.

While the present invention has been described above in terms of specific embodiments, it is to be understood that the invention is not limited to these disclosed embodiments. Many modifications and other embodiments of the invention will come to mind to those skilled in the art to which this invention pertains. These other embodiment are intended to be and are covered by this disclosure. It is intended that the scope of the invention should be determined by those of skill in the art relying upon the disclosure in this specification and the attached drawings.

I claim:

1. An adjustable support apparatus (10) for sanitary fixtures (13), comprising:

a. a plurality of mounting brackets (20) to anchor the device to opposing surfaces (17), wherein the mounting bracket comprises:

i. a mounting plate (22) for engaging a surface (17) and for receiving fasteners (71) to attach the mounting plate (22) to the surface (17);

ii. a suspension support surface (24) extending orthogonally from the mounting plate (22) for supporting an adjustable lift actuator (40); and, iii. a plurality of guide flanges (26) extending from the vertical edges of the mounting plate (22) for guiding the moveable carriages (30);

b. a plurality of adjustable lift actuators (40) suspended from the mounting brackets (20);

c. a plurality of moveable carriages (30) suspended from the adjustable lift actuators (40) and adjustable in height relative to the mounting brackets (20); and, d. a plurality of hanger beams (48) attached to opposing moveable carriages (30) for supporting the underside of the sanitary fixture (13).

2. The device of claim 1 wherein the moveable carriage (30) comprises:

a. a sliding plate (36) for engaging the mounting bracket (22);

b. a hanger support platform (34) extending orthogonally from the sliding plate of the moveable carriage (36) for supporting the end of a hanger beam (48); and, c. an opening (35) in the hanger support platform (34) to allow for passage of the adjustable lift actuator (40).

3. The device of claim 2 wherein the adjustable lift actuator (40) comprises:

a. a rotatable, threaded shaft (41) suspended through a hole (25) in the suspension support surface (24) of the mounting bracket (20) and extending through a hole (35) in the hanger support platform (34) of the moveable carriage (30);

b. an adjusting device (46) for engaging the threaded shaft (41); and, c. a means (42) on the threaded shaft (41) for engaging a tool in order that the tool can impart rotation to the threaded shaft (41).

4. The device of claim 2 wherein the adjustable lift actuator (40) comprises:

a. a fixed, threaded shaft (43) suspended from the support surface (24) of the mounting bracket (20) and extending through a hole (35) in the hanger support platform (34) of the moveable carriage (30); and, b. an adjusting device (47) threadably engaged to the fixed, threaded shaft (43) and supporting the hanger support platform (34).

5. The device of claim 2 wherein the adjustable lift actuator (40) comprises a linked chain suspended from the support surface (24) of the mounting bracket (20) and attached to a hook in the hanger support platform (34).

6. The device of claim 2 wherein the adjustable lift actuator (40) comprises:

a. a shaft with teeth suspended from the support surface (24) of the mounting bracket (20); and, b. a ratcheting device attached to the moveable carriage (30) and engaging the teeth of the shaft.

7. The device of claim 3 wherein the adjustable hanger beam (48) is length adjustable.

8. The device of claim 7 further comprising a non skid surface (18) on the hanger beam (48) for engaging the underside of the sanitary fixture (13) to prevent slippage.

* * * * *